United States Patent [19]

Nelson

[11] Patent Number: 4,669,524

[45] Date of Patent: Jun. 2, 1987

[54] MOLD WITH REMOVED COOLING STRUCTURE AND METHOD FOR CONSTRUCTING THE SAME

[75] Inventor: John T. Nelson, Arlington Heights, Ill.

[73] Assignee: Amsted Industries Incorporated, Chicago, Ill.

[21] Appl. No.: 893,804

[22] Filed: Aug. 6, 1986

[51] Int. Cl.[4] ..... B22D 33/04; B22D 27/04

[52] U.S. Cl. ..... 164/137; 164/128; 164/348; 249/79; 249/80; 165/146; 165/147

[58] Field of Search ..... 165/146, 147; 164/122, 164/125, 126, 128, 137, 339, 342, 348; 249/79, 80, 174

[56] References Cited

U.S. PATENT DOCUMENTS 3,590,904 7/1971 Woodburn, Jr. ..... 164/126

*Primary Examiner*—Nicholas P. Godici
*Assistant Examiner*—Richard K. Seidel
*Attorney, Agent, or Firm*—Charles E. Bouton; Edward J. Brosius

[57] ABSTRACT

Graphite mold blocks with liquid coolant sprays located in bores extending through the blocks. A sleeve for retarding the cooling of the mold adjacent the spray entrance ends of the bores serves to reduce the temperature differential along the height of the block.

12 Claims, 5 Drawing Figures

MOLD WITH REMOVED COOLING STRUCTURE AND METHOD FOR CONSTRUCTING THE SAME

FIELD OF THE INVENTION

The present invention relates to metal casting and more particularly to an improved graphite mold structure and the method for forming the mold.

BACKGROUND OF THE INVENTION

Graphite molds are used in the casting of steel particularly of steel slabs. Such mold structure generally includes a pair of spaced graphite side blocks and end, top and bottom blocks which are arranged to form a cavity of rectilinear cross section. Molten steel is poured into the cavity and solidified therein. The blocks are separated after solidification of the steel and the slab is removed.

Continual and repetitive use of the graphite blocks requires machining of the mold faces to maintain the desired surface characteristics of the cast slab. This machining gradually reduces the thickness of the mold side blocks. The thickness reduction causes the temperature of the graphite blocks to increase more rapidly.

This temperature increase is undesirable because the residual heat remaining in the graphite blocks increases the cooling or solidification times of subsequent castings. In fact it is essential that heat be removed from the blocks in order that the optimum solidification occur during subsequent castings.

One such method of cooling the graphite molds is described in U.S. Pat. No. 3,590,904 dated July 6, 1971. The method comprises generally the application of a water spray in heigthwise extending and laterally spaced passages or bores formed in the graphite blocks. While this method has been generally effective it has been demonstrated that a temperature gradient occurs along the length of each of the passages with a gradual increase occurring as the spray is applied further from the source of the liquid coolant. The temperature difference along the height or length of the passages is further implemented upon repetitive use of the blocks without sufficient time between castings to allow the high temperature to drop to the lowermost temperature along the passage.

SUMMARY OF THE INVENTION

By the present invention it is proposed to provide a new and improved graphite block mold structure which overcomes the difficulties encountered heretofore during cooling.

This is accomplished generally by the provision of graphite block mold which is provided with a plurality of heigthwise extending and laterally spaced passages through each of which extend spray pipes which are connected to a common header extending along the length of the mold block. The spray pipes are provided with spray nozzles through which the coolant liquid such as water is applied along the height of the block. To maintain the temperature gradient of the graphite between the source of liquid coolant and the end remote from the source at a minimum, means are provided in the ends of the passages or bores adjacent to the header to reduce the transfer of the cooling effect of the coolant to the graphite. The cooling rate is reduced by providing a shield which reduces the heat transfer characteristics of the carbon so that the temperature gradient along the height of the graphite block is substantially reduced.

More particularly the coolant passages are each provided with a metallic shield inserted adjacent the header ends thereof to which the heat released during casting is transferred. The metallic inserts may be sleeves which have a lesser heat conductive rate than the graphite so that while the temperature is substantially reduced during the spraying of the coolant it is not as great a temperature drop as occurs in the unshielded graphite.

The shields are preferably formed as a lengthwise split cylinder so as to permit contraction and expansion thereof within the bores without damage to the graphite blocks. The shields are inserted so as to be snugly seated within the respective coolant passages thereby to maintain intimate contact with the graphite.

By the present invention there is provided a novel method for inserting the metallic sleeves into the coolant passages. This is accomplished by inserting an open ended cylinder forming tool in one end of the graphite passage. A cable is extended through the passage and a flat metal sheet having a width greater than the circumference of the coolant passage is drawn through the forming tool to shape and curl the metal sheet into a cylindrical tube which is expandable and snugly seated within the passage when drawn therethrough. Power means is utilized to draw the metal sheet through the passage to the end opposing the forming tube tool. Upon reaching the other end the tube is detached from the cable.

Further features of the invention will be apparent from the following specification.

DESCRIPTION OF THE PREFERRED EMBODIMENTS

Figure 1:
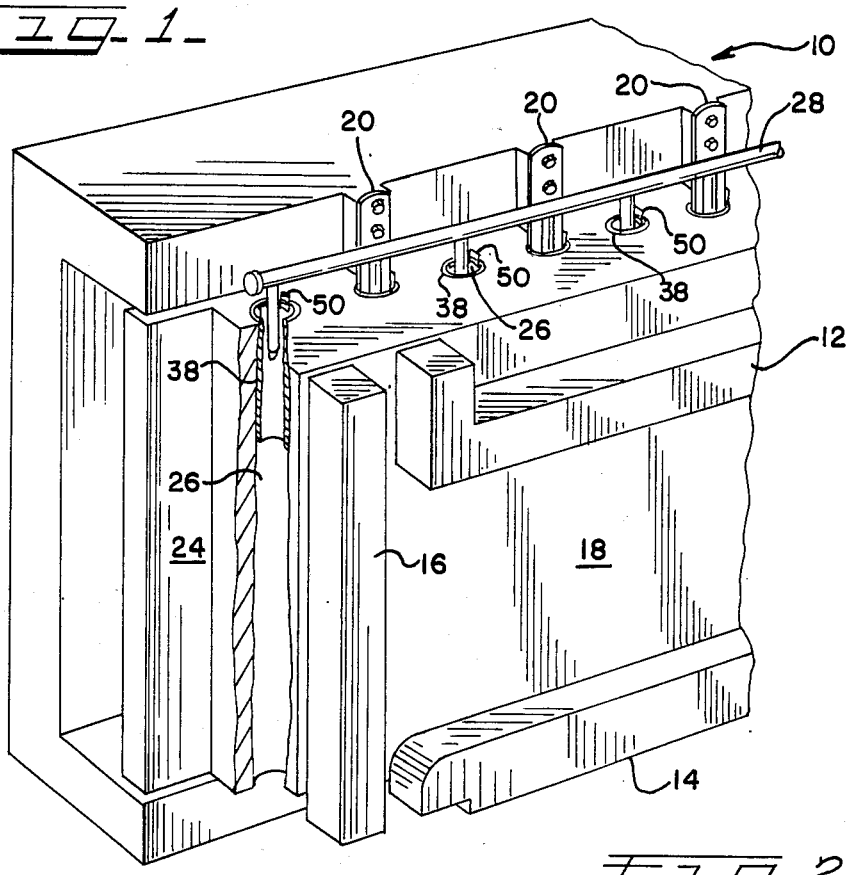
FIG. 1 is a perspective view of a graphite mold incorporating the structure of the present invention.
Figure 2:
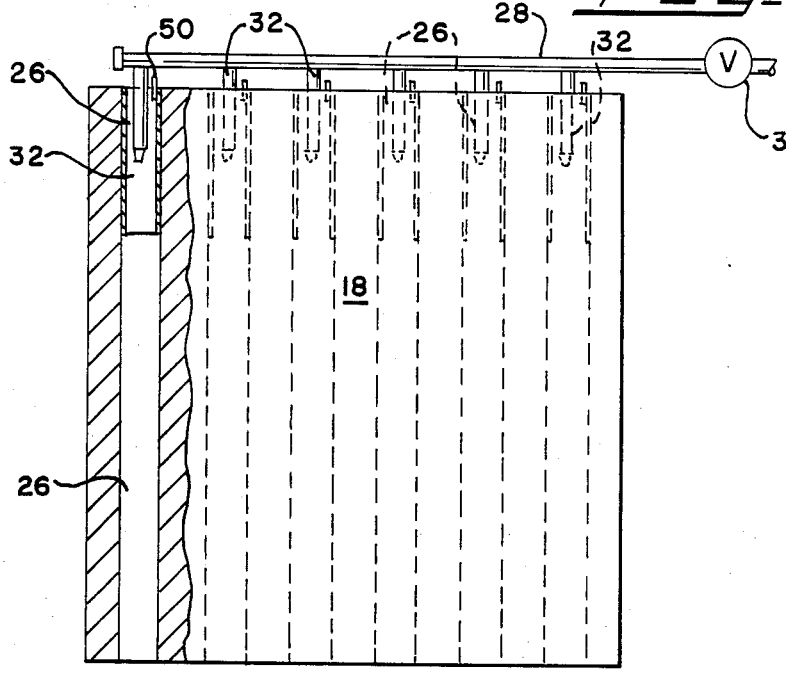
FIG. 2 is a side elevational of the graphite mold partly in cross section showing the structure of the present invention.
Figure 3:
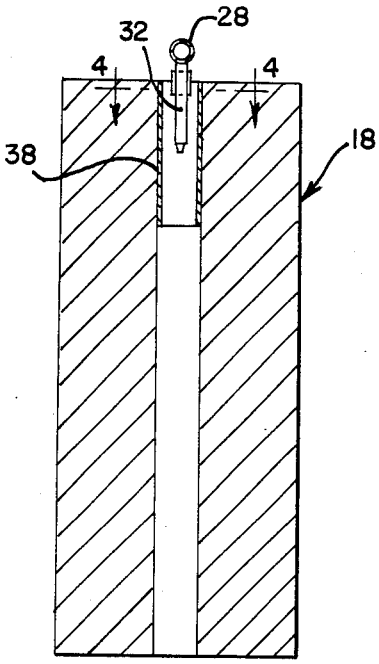
FIG. 3 is a sectional end view of a coolant passage embodying the structure of the present invention.

Referring now the drawings there is shown a graphite slab mold 10 for casting steel slabs. The slab mold includes a top block 12, a bottom block 14 and end block 16 engagable with each other and two opposing side blocks 18 of which only one is illustrated. The side blocks 18 are retained by keeper plates 20 within a flask 22 having a strong back 24 to impart strength to the structure. The blocks 12, 14, 16 and 18 are arranged to define a casting cavity there between. The blocks 12, 16 and 18 are movable into and out of the casting position by power operated means not shown.

Each of the graphite side blocks 18 is formed with a plurality of vertical or upstanding cylindrical open ended bores or passages 26. Extending along the length of the side blocks 18 is a header pipe 28 which is connected to a suitable source of coolant such as water under pressure. Controlling the flow of coolant through the header 28 is a valve 30. Extending from the header 28 are a plurality of spray pipes 32 extending into the bores or passages 26. The spray pipes 32 are each formed with a spray nozzle 34 for spraying the side blocks 18. A trough or other drain means may be located beneath the bores 26 of the blocks 18 to suitably dispose of any spent water which has not vaporized. As should be readily apparent the coolant or water sprayed in the bores serves to reduce the heat from the side blocks 18. The temperature reduction resulting from the spraying serves to minimize the time the graphite mold is above the graphite oxidation temperature of 852° which is beneficial to the casting process. For a more detailed description of an early embodiment of the cooling structure described above, reference is made to the aforementioned U.S. Pat. No. 3,590,904.

It has been discovered that with the above arrangement the rate of cooling of the side blocks at the ends of the bores 26 adjacent the header 28 is greater than at the ends remote therefrom. Such temperature gradients may vary between about 250° F. to 600° F. Under some extreme conditions the temperatures may vary from room temperature to a maximum of about 1100° F. Temperature gradients of this magnitude are undesirable primarily because it slows down the casting process or contributes to inferior castings.

By the present invention this problem is remedied by providing means for reducing the conductivity of the heat or conductivity of the heat through the graphite mold adjacent the heads 28. This is accomplished by a metal shield 38 located in the bore 26 adjacent to the header 28 so that the coolant is not directly discharged or sprayed on the graphite but instead the coolant effect is transferred through the shield 38. This retards the cooling rate of the graphite mold block 18 adjacent the shielded portion of the bore 26 while the remaining volume of graphite adjacent the unshielded portion is subjected to the approximate rate of heat loss as heretofore. Thus the temperature gradient between the opposite ends of the bores or coolant channels 26 is materially reduced and stabilized.

The sleeve 38 is preferably made from a non-corrosive material such as stainless steel or the like to withstand the exposure to the coolant water without oxidation and which is also capable of retaining its tensil strength under the temperature to which it is exposed in the bore 26.

In the preferred form of the invention the sleeve 38 is made from a sheet of 26 gauge (0.018") 301 stainless steel. The sheet is of sufficient width to be rolled or curled into an open ended cylinder with overlapping edges 40 and 42 that is closely fitted within a bore 26; and of a length sufficient to shield an otherwise overcooled length of a bore 26. The overlapping edges 40 and 42 are detached from each other to permit expansion and contraction of the cylindrical shield 38 throughout a range of temperatures from about 250°-600° F. and possibly as high as 1100° F., to which it may be exposed during use and thereby avoid damaging the mold structure yet remain sprung into contact with the bore wall. It has been found that adequate temperature gradient reduction is achieved with a cylinder of at least about 10% and preferably about 25% of the length of the bore 26.

A typical construction of a side block has a 24" thickness, a width of 24", 30" or 48" with a height of 60" to 118". The cooling bores or passages 26 are normally located on 8" centers along the width of the block with a 3" diameter. A flow rate of about 0.5 to about 5.0 gallons per minute or more may be maintained at each of the spray pipes 32.

Figure 5:
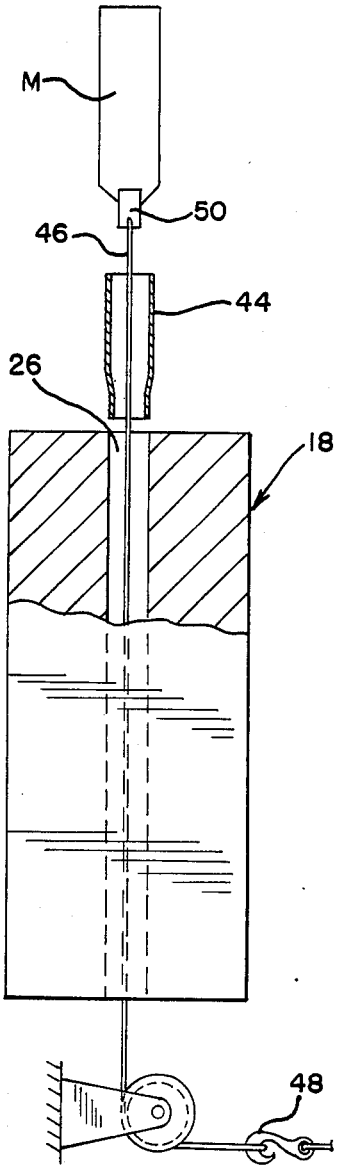
FIG. 5 is a schematic illustration showing the method employed in assembling the temperature retention shield to the graphite mold.
Figure 4:
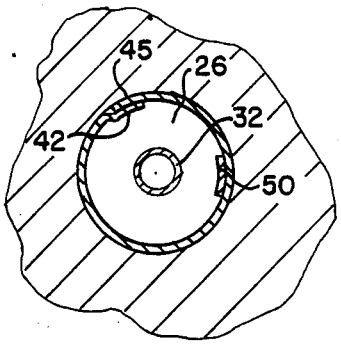
FIG. 4 is an enlarged fragmentary view taken generally along the line 4—4 of FIG. 3.

In accordance with the present invention as shown in FIG. 5 the sleeve or shield 38 is formed from metal sheet M and rolled or curled into the expandable or contractable sleeve 38 having overlapping edges 40 and 42. The rolling or curling is performed by drawing the sheet M through an open end bell shaped tubular forming tool 44 which is positioned at an end of the passage or bore 26 remote from the header 28

To accomplish this a tong or clip 50 is fastened to one end of the metal sheet M along the surface that will be inward of the formed sleeve 38 and the clip 50 is oriented toward the forming tool 44. A cable 46 is then inserted through the bore 26 from the other end adjacent header 28 and through the tubular forming tool 44. The header end of the cable 46 is connected to a suitable source of pulling power, such as a winch or crane hook 48 or the like; and the other end of cable 48 is detachably connected to the tong or clip 50 attached to the sheet M. Power is then applied to the hook 48 and cable 46 to draw the metal plate M through the forming tube 44 whereupon the sheet M is rolled into its cylindrical form 38 and drawn inwardly in snugly engaging relationship through the bore 26 until the clip 50 protrudes from the other (header) end. The power is then disconnected and the cable 46 is detached from clip 50. The sleeve 38 in its outwardly sprung form is then retained in intimate contact with the wall of the bore 26. Although the clip 50 may also be removed it is preferred to leave it in place against the possibility that a need may arise to remove the sleeve 38 for equipment servicing and the like.

What is claimed is:

1. In a metal casting mold having a side block including a plurality of vertical bores into which liquid coolant is sprayed along the height thereof from spray pipes extending into the bores from a lengthwise extending header connected to a liquid coolant, the improvement comprising a sleeve inserted into each of said bores for maintaining the temperature differential of the mold along the height of the bores at a minimum.

2. The invention as defined in claim 1 wherein said sleeve is located in said bore adjacent said header.

3. The invention as defined in claim 2 wherein said sleeve extends into said bore at least about 10% of the height of said side block.

4. The invention as defined in claim 3 wherein said sleeve is made from a non-corrosive metal.

5. The invention as defined in claim 4 wherein said sleeve is the form of a contractable and expandable cylinder so as to remain in snug contact within said bore as the temperature of said block changes during the molding process.

6. The invention as defined in claim 5 wherein said sleeve is a stainless steel having a thickness of about 0.018".

7. The invention as defined in claim 5 wherein said expandable and contractable cylindrical sleeve includes overlapping edges extending the full length of said sleeve.

8. The method of fabricating and inserting a heat shield within a portion of a cooling bore formed within the wall of a mold for cast metal, said method comprising:

positioning a flat sheet of shield material at one end of a cooling bore, extending a cable through the cooling bore and attaching said cable to an end of said flat sheet, pulling said cable from beyond another end of said bore opposite said one end so as to draw said sheet into said bore, curling said flat sheet into a cylindrical sleeve to fit closely within said bore said curling being accomplished at the entry to said one end of said cooling bore, continuing to pull said cable until said cylindrical sleeve is located at a selected position within said cooling bore, and then detaching said cable from said sleeve.

9. The method of claim 8 wherein said flat sheet is of a width slightly in excess of the circumference of said bore so as to form a sleeve having slightly overlapped longitudinal edges whereby the sleeve will be sprung against the wall of said bore yet able to expand and contract with temperature change.

10. The method of claim 8 wherein the length of said sheet is at least about 10% of the length of said cooling bore and the sleeve is located at an end of said cooling bore.

11. The method of claim 8 wherein the sheet of shield material is curled by drawing the sheet through a bell shaped die adjacent said one end of said cooling bore.

12. The method of fabricating and inserting a heat shield made from flat sheet material into a cooling bore in a graphite block of a metal casting mold comprising:

positioning an open ended cylindrical forming tool on said block aligned with said cooling bore, training a cable through said forming tool and said cooling tube, attaching a metal sheet having a width greater than the circumference of said bore to one end of said cable, attaching the other end of said cable to a source of pulling power, energizing said source of pulling power, and drawing said sheet through said forming tool to form a cylinder and pulling said formed cylinder to the opposite end of said bore and releasing said cable from said cylinder.

* * * * *